United States Patent [19]

Van't Hof

[11] 4,322,077

[45] Mar. 30, 1982

[54] WRIST BAND FOR TENNIS RACKETS AND THE LIKE

[76] Inventor: Gustaaf Van't Hof, 10021 Lesterford Ave., Downey, Calif. 90241

[21] Appl. No.: 113,957

[22] Filed: Jan. 21, 1980

[51] Int. Cl.[3] ..... A63B 49/08

[52] U.S. Cl. ..... 273/75; 24/115 K; 24/115 H; 224/219; 224/221; 224/220

[58] Field of Search ..... 145/29 R, 61 R; 224/45 R, 45 J, 51–55, 219–222; 272/75; 273/29 A, 67 R, 67 B, 72 R, 73 J, 75, 81 R, 81 D, 81.4, 162, 189 A, 26 E, 200 R, 84 R, 58 C, 184 B, 185 C

[56] References Cited

U.S. PATENT DOCUMENTS

| | | | |
|---|---|---|---|
| 765,605 | 7/1904 | Wade | 273/84 R |
| 1,490,651 | 4/1924 | Waldorf | 273/84 R |
| 1,651,057 | 11/1927 | Goldstein | 272/75 |
| 2,044,240 | 6/1936 | Daniels | 46/51 |
| 2,253,075 | 8/1941 | Johnson | 272/75 |
| 2,572,889 | 10/1951 | Strykower | 24/115 H X |
| 2,650,400 | 9/1953 | Kellems | 24/115 H X |
| 3,113,782 | 12/1963 | Guier | 273/81 D X |
| 3,266,464 | 8/1966 | Davis | 24/115 H X |
| 3,729,195 | 4/1973 | Hutt et al. | 273/58 C |
| 3,934,873 | 1/1976 | Griffin | 273/58 C X |
| 3,995,872 | 12/1976 | Joseph | 273/81 D X |

FOREIGN PATENT DOCUMENTS

| | | | |
|---|---|---|---|
| 1116894 | 2/1956 | France | 224/220 |
| 1507343 | 11/1967 | France | 272/75 |
| 599749 | 11/1959 | Italy | 272/75 |
| 140131 | 8/1930 | Switzerland | 273/29 A |
| 293339 | 7/1928 | United Kingdom | 224/220 |
| 601946 | 5/1948 | United Kingdom | 272/75 |
| 755736 | 8/1956 | United Kingdom | 272/75 |

*Primary Examiner*—Richard J. Apley

*Attorney, Agent, or Firm*—Christie, Parker & Hale

[57] ABSTRACT

A wrist band is attached to the handle of a tennis racket for use in securing the tennis racket to the wrist of a player. The wrist band can be attached to the handle of an existing tennis racket without requiring removal of the grip. The wrist band includes a flexible strap having a pair of ends fixed together by a sleeve secured over the adjacent ends of the strap for forming a fixed loop of the wrist band. The sleeve has a generally rounded outer surface and a rim that projects outwardly from the rounded surface of the sleeve. A base plate loosely fitted around the outer surface of the sleeve protrudes outwardly away from the rim on the sleeve and is retained around the sleeve by engagement with the rim. The sleeve and the base plate can be inserted in a hole drilled in the end of the racket handle, with the base plate bearing against the end of the handle and bridging the hole to retain the strap in the end of the handle. A pair of beads are slidably secured in tandom around the ends of the strap adjacent the sleeve. The bead closest to the sleeve can be tightened against the end of the handle, while the other bead can slide away from the end of the handle for tightening the loop around the player's wrist.

12 Claims, 4 Drawing Figures

WRIST BAND FOR TENNIS RACKETS AND THE LIKE

BACKGROUND OF THE INVENTION

During tennis matches or other sporting events exertion and humid weather causes a player to perspire. This condition sometimes causes him to lose his grip on the racket. The ultimate outcome of a tennis match may depend on winning or losing a single point. If a player loses control over his racket when serving, or playing an overhead ball, the racket may slip and crash into the concrete court; the impact may break the racket. This event delays play, may cause the player to lose a point by default and incur the expense of new equipment.

Use of the tether eliminates fear of losing one's grip. This gives the player confidence and allows him to give maximum effort in the game. When a player under psychological pressure during a match loses his composure, the tether prevents him from throwing his racket. Another significant application of the tether concerns its use in the construction industry. For example, in the building trades, carpenters or steel workers, who work on high-rise buildings, may lose control of a hand tool. Work will be interrupted in order to retrieve the tool. The falling tool may also cause injury to people below. Such an event always lowers work productivity.

While applications of other types of wristbands are known, the use in tennis and in the construction industry, and the special construction of the snap-on fastener of this tether are unique. The demonstrated need of this tether in tennis matches and in the building trades indicates a potential usage of this invention not earlier envisioned.

SUMMARY OF THE INVENTION

The present invention is a tether, or wrist band. It provides a secondary binding and safety strap. Surrounding the wrist and combined into a single leash, it is attached to tennis rackets, other sporting goods equipment, hand tools or other implements to safe-guard against loss during slippage. The tether can be manufactured from leather, plastic, nylon cord or other flexible material. Sliding beads may be used to tighten the looped portion of the tether, surrounding the wrist. The beads may be made of plastic, glass, wood or some other material. The tether's connection with the tennis racket is accomplished by using a special fastener. The tether is provided with a specially spliced terminal. The fastener and the splice are both part of this invention. The objective of the tether is to provide a loose, non-restrictive safety band. Many tennis players spin their rackets between points. The special fastener which allows rotation does not interfere with this habit. The execution of different strokes such as forehand strokes, backhand strokes, volleys, and particularly the service all may require changing the grip. This tether allows free racket handling to carry out such maneuvers. Free movement is also required in carpentery and handling of tools. To avoid the tether from cutting into the player's hand when a racket inadvertently slips out of his control, the band may be widened around the hand. The tether's appearance and strength can be enhanced by braiding the tether's loop.

Most tennis rackets now in use do not have the benefit of this safety tether. In the future rackets may be made with a tether already attached or be provided with the proper hole in the butt cap for attachment of a tether later when desired.

BRIEF DESCRIPTION OF THE DRAWINGS

The construction of the present invention will be more fully understood from the following description in conjunction with the accompanying drawings.

PREFERRED CONCEPT OF THIS INVENTION

Figure 1:
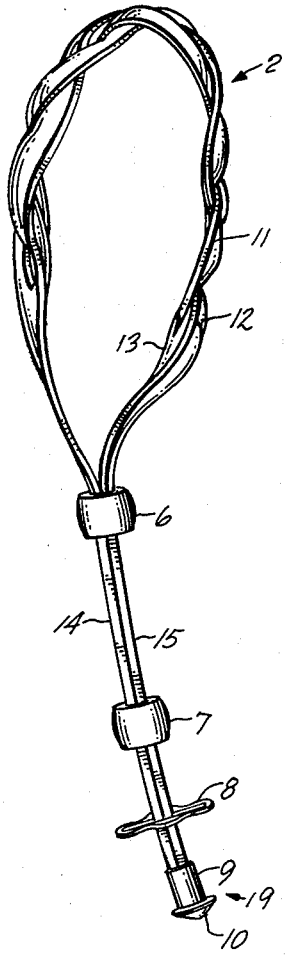
FIG. 1 is a perspective view of the tether showing also the fastener and the spliced ending. It shows further the leash portion between the beads, and the braided wrist portion of the tether.

FIG. 1 represents the preferred concept of the invention. The tether band (1) is made out of one piece of flexible material such as leather, plastic, nylon, or other band material, The braided wrist band (2) consists of the three straps (11), (12) and (13) interwoven to form an elegant band surrounding the wrist. Each of the straps (11), (12) and (13) is equal in width and equal or slightly wider than the leash straps (14) and (15) which are held together by beads (6) and (7) to form the tether leash (3). Bead (6) may be used to tighten the tether around the wrist and bead (7) is used to secure the sleeve (9) when inserted into the butt cap of the tennis racket. The special snap-on fastener (4) has been invented for this tether. It is made simultaneusly a part of this disclosure, together with the spliced ending (5). The splice of both leash straps is made by fitting the single tubular sleeve (9) tightly over leash ends (14) and (15). A wedge screw (10) is screwed in between both leash ends (14) and (15). The sleeve (9) is provided with a rim (19) which has an outside dimension larger than the sleeve itself. The wedge provided by the screw (10) has the unique feature that the wedging action is activated either by a tensile force in the tether leash(3), or by tightening the screw(10) further into tubular sleeve (9). The exposed screw ending (10) may be dipped in liquid plastic, mainly for aestetic reasons. The leash ends (14) and (15) can also be spliced into a single end by the use of liquid plastic, or by injection molding. The shape of the mold is to resemble the shape of the tubular sleeve (9).

Figure 2:
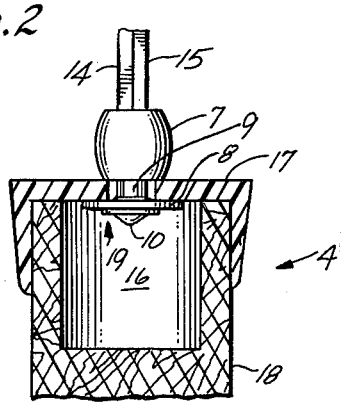
FIG. 2 is a cross section of the fastener detail showing the tumble self-locking base plate and the spliced ending.

Though the tether could be permanently attached to newly fabricated tennis rackets or other implements, not every player may wish to use this safety band, in spite of the benefits. This will require that the tether can be attached only when desired. There are millions of tennis rackets already in use which may require a tether to be attached after manufacture. Therefore, the special fasterner (4) has been invented which snaps into the single hole (16) in the handle of the tennis racket (18), handtool, or implement. The fastener consists of the spliced ending (5), the base plate (8) and the bead (7). The base plate (8) is of an oval or elliptical shape, sometimes bent with a slot in the center which is fitted over the leash straps (14) and (15). The spliced end (5) and the base plate (8) are inserted separately through hole (16) in the handle of the tennis racket (18) or a hole provided in another implement. The base plate is made narrow enough to pass through the hole (16) in the tennis racket handle (18) or other implement. The hole in the base plate (8) is made large enough to fit over the main body of the tubular sleeve (9) but not over the rim (19) provided at the end of the sleeve. When the leash is pulled the base plate will tumble sideways bridging the opening. Bead (7) may be fitted over the tubular sleeve (9) to form a secure connection. The fastener forms a swival connection locked inside the opening allowing free rotation. The fastener unit as shown in FIG. 2 is installed in a hollow racket grip. The hole (16) was drilled through the butt cap in the handle (18) of the tennis racket. The tubular sleeve (9) and the base plate (8) are inserted through the hole (16). The tubular sleeve (9) is pulled back through both the hole provided in the base plate (8) and the hole which extends through the butt cap. (17). The rim (19) on the tubular sleeve (9) prevents it from slipping through the base plate (8). Bead (7) is placed on the portion of tubular sleeve (9) which now projects outside the racket butt cap to secure the connection. The free rotation of the tubular sleeve (9) forms a swivel or hinge connection.

The unit can also be easily installed in any wall or ceiling by drilling the hole (16) and inserting both the tubular sleeve (9) and the base plate (8) through the hole.

It is obvious to any one skilled in the art that when installed during the manufacturing of rackets the base plate can be eliminated if the rim (19) of the tubular sleeve (9) is made large enough.

Figure 3:
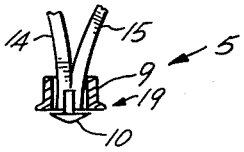
FIG. 3 is a cross section of the spliced ending.

The spliced ending (5) of the fastener unit as shown in FIG. 3 consists of a tubular sleeeve (9), in which the two flexible members or lease ends (14) and (15) are inserted and the tightening screw (10). By tightening screw (10) the two leash ends (14) and (15) are wedged firmly against the inside of tubular sleeve (9) forming a solid splice. This spliced end may also be made from epoxy or other plastics by injection molding. The enlarged rim (19) is used to secure the ending in a wall or ceiling or other implement.

Figure 4:
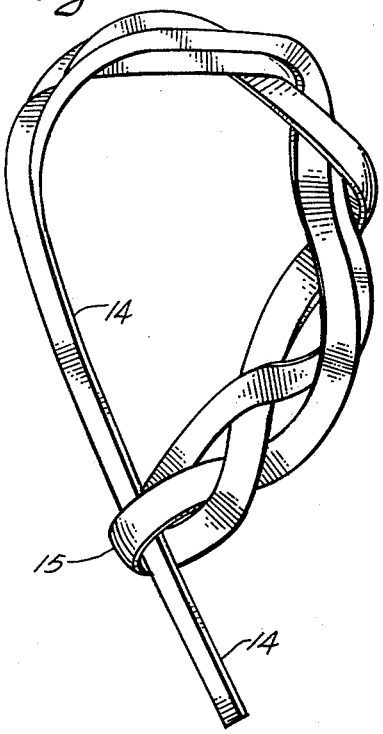
FIG. 4 is a view of an alternative design of the wrist band with one end sliding over the other end.

The tether or wrist band shown in FIG. 4 is a variation on the preferred embodyment showing leash end (15) shortened and provided with a hole through which leash end (14) fits. Leash end (14) is provided with the fastener and attached to the racket or other implement while leash end (15) slides over leash end (14) to form a band around the wrist, eliminating bead (6). The portion around the wrist can be braided as shown in FIG. 4 or can be a straight or widened band.

I claim:

1. A wrist band for attachment to the handle of a tennis racket or the like for use in securing the racket to the wrist of a player, wherein the racket handle has a grip and an end face adjacent the end of the grip, and wherein the wrist band can be inserted into a hole drilled in said end face without removing the grip from the racket, the wrist band comprising:

an elongated flexible strap having a loop spaced from an end of the strap;

a fixed sleeve secured to the end of the strap, the sleeve having a generally rounded outer surface;

a rim on the sleeve projecting outwardly from the generally rounded outer surface of the sleeve;

a base plate loosely fitted around the outer surface of the sleeve, the base plate protruding outwardly away from the rim on the sleeve and being retained around the outer surface of the sleeve by contact with the rim, the sleeve and the base plate being adapted to be inserted in the hole drilled in the end face of the racket handle, with the base plate bearing against the end face and bridging the hole with the rim against the base plate to retain the strap in the end of the racket handle;

means secured to the strap on the side of the base plate opposite the rim of the sleeve for holding the strap in a fixed position relative to the end face of the handle; and means for adjusting the size of the loop for tightening the loop around the player's wrist.

2. The wrist band according to claim 1 in which the loop portion of the wrist band is braided.

3. The wrist band according to claim 1 in which the end of the strap has adjacent end portions which are inserted in a hollow interior of the sleeve; and including a fastener extending through the rim and into the interior of the sleeve for wedging the adjacent end portions of the strap against the sleeve.

4. The wrist band according to claim 1 in which the means for holding the strap comprises a slidable bead on the strap.

5. The wrist band according to claim 4 in which the means for adjusting the loop comprises an additional bead slidably secured to the strap in tandem with the other bead.

6. The wrist band according to claim 1 in which the sleeve has a hollow interior and the end of the strap is separated into a pair of end portions inserted in the hollow interior of the sleeve; and a fastener with screw threads extending into an end of the sleeve and embedded between the end portions of the strap inserted in the sleevel for frictionally wedging the end portions of the strap against the sleeve to bind the end portions of the strap inside the sleeve, the sleeve providing an exterior binding element at the end of the strap.

7. A racket and safety binding combination comprising:

a racket handle, a face adjacent an end of the handle, and a hole drilled in the end face;

an elongated flexible strap having a loop spaced from an end of the strap;

a fixed sleeve secured to the end of the strap, the sleeve having a generally rounded outer surface;

a rim on the sleeve protruding outwardly from the generally rounded outer surface of the sleeve;

a base plate loosely fitted around the outer surface of the sleeve, the base plate protruding outwardly from the rim of the sleeve and being retained around the sleeve by contact with the rim, the sleeve and base plate being inserted in the hole drilled in the end face, with the base plate bearing against the end face and bridging the hole with the rim against the base plate to retain the strap in the end of the handle, with the rounded sleeve being disposed in the hole in the end face to provide a swivel attachment of the wrist strap to the handle;

means secured to the strap on the side of the base plate opposite the rim of the sleeve for holding the strap in a fixed position relative to the end face of the handle; and means for adjusting the size of the loop for tightening the loop around the player's wrist.

8. The combination according to claim 7 in which the wrist band is braided.

9. The combination according to claim 7 in which the means for holding the strap comprises a slidable bead on the strap.

10. The combination according to claim 9 in which the means for adjusting the loop comprises an additional bead slidably secured to the strap in tandem with the other bead.

11. The combination according to claim 7 in which the sleeve has a hollow interior; in which the end of the strap has adjacent end portions inserted into the interior of the sleeve; and including a fastener extending through the rim and into the sleeve for wedging the adjacent end portions of the strap against the sleeve.

12. The combination according to claim 7 in which the sleeve has a hollow interior, and the end of the strap is separated into a pair of end portions inserted in the hollow interior of the sleeve; and a fastener with screw threads extends into the end of the sleeve and is embedded between the end portions of the strap inserted in the sleeve for frictionally wedging the end portions of the strap against the sleeve to bind the end portions of the strap inside the sleeve, the sleeve providing an exterior binding element at the end of the strap.

* * * * *

UNITED STATES PATENT AND TRADEMARK OFFICE

CERTIFICATE OF CORRECTION

PATENT NO. : 4,322,077

DATED : March 30, 1982

INVENTOR(S) : Gustaaf Van't Hof

It is certified that error appears in the above-identified patent and that said Letters Patent are hereby corrected as shown below:

Column 2, Line 23, "material," should read -- material. --; Line 33, "simultaneusly" should read -- simultaneously --; Line 45, "aestetic" should read -- aesthetic --; Line 56, "fasterner" should read -- fastener --. Column 3, Line 6, "swival" should read -- swivel --; Line 14, after "cap" delete the period; Line 30, "lease" should read -- leash --; Line 39, "embodyment" should read -- embodiment --. Column 4, Claim 6, Line 31, "sleevel" should read -- sleeve --.

Signed and Sealed this

*Twenty-first* Day of *September 1982*

[SEAL]

*Attest:*

GERALD J. MOSSINGHOFF

*Attesting Officer*

*Commissioner of Patents and Trademarks*